US009713352B2

(12) United States Patent
Demarest

(10) Patent No.: US 9,713,352 B2
(45) Date of Patent: Jul. 25, 2017

(54) CRUMPLE ZONE GARMENTS PROVIDING ENHANCED FIT

(75) Inventor: Nathan Demarest, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 858 days.

(21) Appl. No.: 13/359,765

(22) Filed: Jan. 27, 2012

(65) Prior Publication Data

US 2013/0191958 A1 Aug. 1, 2013

(51) Int. Cl.

| | |
|---|---|
| ***A41D 1/00*** | (2006.01) |
| ***A41D 3/02*** | (2006.01) |
| ***A41D 27/10*** | (2006.01) |
| ***A41B 1/00*** | (2006.01) |
| ***A41B 1/08*** | (2006.01) |
| ***A41D 3/00*** | (2006.01) |

(52) U.S. Cl.

CPC ..... *A41D 3/00* (2013.01); *A41D 27/10* (2013.01); *A41D 2400/38* (2013.01)

(58) Field of Classification Search

CPC .... A41D 27/10; A41D 27/28; A41D 2300/22; A41D 13/02; A41D 2600/102; A41D 3/00; A41D 13/0015; A41D 2400/38; Y10S 2/01

USPC ..... 2/115, 93, 125, 108, DIG. 1, 69

See application file for complete search history.

(56) References Cited

U.S. PATENT DOCUMENTS

| | | | | |
|---|---|---|---|---|
| 601,489 | A * | 3/1898 | Tim | 2/115 |
| 1,169,256 | A * | 1/1916 | Grimm et al. | 2/108 |
| 1,973,419 | A * | 9/1934 | Trageser | 2/93 |
| 2,094,643 | A * | 10/1937 | Fellroth | 2/115 |
| 2,119,293 | A * | 5/1938 | Sawyer | 2/125 |
| 2,280,479 | A * | 4/1942 | Cohen | 2/76 |
| 2,305,406 | A * | 12/1942 | Joseph et al. | 2/115 |
| 2,314,226 | A * | 3/1943 | Lee | 2/94 |
| 2,447,989 | A * | 8/1948 | Previdi | 2/125 |
| 2,500,084 | A * | 3/1950 | Metzger | 2/97 |
| 2,554,380 | A * | 5/1951 | Olrich et al. | 2/90 |
| 2,941,210 | A * | 6/1960 | Bren | 2/115 |
| 3,037,210 | A | 6/1962 | Neuman | |
| 3,086,214 | A * | 4/1963 | Lash | 2/79 |

(Continued)

FOREIGN PATENT DOCUMENTS

| | | | | |
|---|---|---|---|---|
| FR | 2677855 A1 * | 12/1992 | | A41D 13/00 |
| GB | 361815 A * | 11/1931 | | |
| WO | WO 2005004649 A2 * | 1/2005 | | |

*Primary Examiner* — Jameson Collier

(74) *Attorney, Agent, or Firm* — Shook, Hardy & Bacon L.L.P.

(57) ABSTRACT

A garment constructed of textile panels that provides proper fit across a variety of postures is provided. A plurality of primary textile panels have a first crumplability. At least one secondary textile panel has a second crumplability, the second crumplability being greater than the first crumplability. A plurality of seams joins the plurality of primary textile panels and the at least one secondary textile panel substantially along the edges of the panels to form a garment that when worn by a person in a non-extended posture covers intended portions of the person fully with only the plurality of primary textile panels extended and the at least one secondary textile panel non-extended. When the garment is worn by a person in an extended posture, the garment covers the intended portions of the person fully with both the plurality of primary textile panels and the at least one secondary textile panel extended.

4 Claims, 3 Drawing Sheets

(56) References Cited

U.S. PATENT DOCUMENTS

| | | | | | |
|---|---|---|---|---|---|
| 3,153,793 | A | | 10/1964 | Lepore | |
| 3,654,632 | A | * | 4/1972 | Lacroix | 2/125 |
| 3,801,987 | A | * | 4/1974 | Thompson, Jr. | 2/125 |
| 4,195,362 | A | * | 4/1980 | Rolando | A41D 3/00 2/108 |
| 4,241,461 | A | | 12/1980 | Jolly | |
| 4,722,099 | A | * | 2/1988 | Kratz | 2/79 |
| 4,896,379 | A | | 1/1990 | Kape | |
| 5,072,454 | A | * | 12/1991 | Trahan | A41D 13/0005 2/125 |
| 5,105,478 | A | * | 4/1992 | Pyc | 2/115 |
| 5,138,717 | A | | 8/1992 | Tolton | |
| 5,388,271 | A | * | 2/1995 | Sessoms | A41D 13/0015 2/113 |
| 5,410,759 | A | | 5/1995 | Hari | |
| 5,608,913 | A | * | 3/1997 | Lacoste | 2/115 |
| 5,727,256 | A | * | 3/1998 | Rudman | 2/115 |
| 6,279,161 | B1 | * | 8/2001 | Johnston | 2/69 |
| 6,353,934 | B1 | * | 3/2002 | Tada et al. | 2/115 |
| 6,427,242 | B1 | * | 8/2002 | Bush et al. | 2/69 |
| D491,713 | S | * | 6/2004 | Wilson, II | D2/849 |
| 6,817,029 | B2 | * | 11/2004 | Mazzarolo | 2/22 |
| 6,895,597 | B1 | | 5/2005 | Rakic | |
| 7,540,037 | B1 | * | 6/2009 | Bittler et al. | 2/69 |
| 2003/0051286 | A1 | | 3/2003 | Gregg | |
| 2003/0061650 | A1 | * | 4/2003 | Emanuel | 2/115 |
| 2003/0140404 | A1 | * | 7/2003 | Golde | 2/465 |
| 2004/0158910 | A1 | * | 8/2004 | Bay | 2/69 |
| 2005/0028242 | A1 | * | 2/2005 | Thomas | A41D 1/04 2/84 |
| 2005/0034204 | A1 | * | 2/2005 | Kassai et al. | 2/69 |
| 2007/0028351 | A1 | | 2/2007 | Coolik | |
| 2007/0271671 | A1 | * | 11/2007 | Okajima | 2/69 |
| 2008/0060112 | A1 | * | 3/2008 | Driehorst | A41D 13/015 2/85 |
| 2008/0184454 | A1 | * | 8/2008 | Collier | 2/93 |
| 2008/0196140 | A1 | * | 8/2008 | Mayerson et al. | 2/84 |
| 2009/0077710 | A1 | * | 3/2009 | Bay | 2/87 |
| 2009/0098801 | A1 | * | 4/2009 | Pedersen et al. | 450/7 |
| 2010/0242151 | A1 | * | 9/2010 | Mather | 2/115 |
| 2011/0035859 | A1 | | 2/2011 | Koga | |
| 2015/0374050 | A1 | * | 12/2015 | Farron | A41D 3/00 2/95 |

* cited by examiner

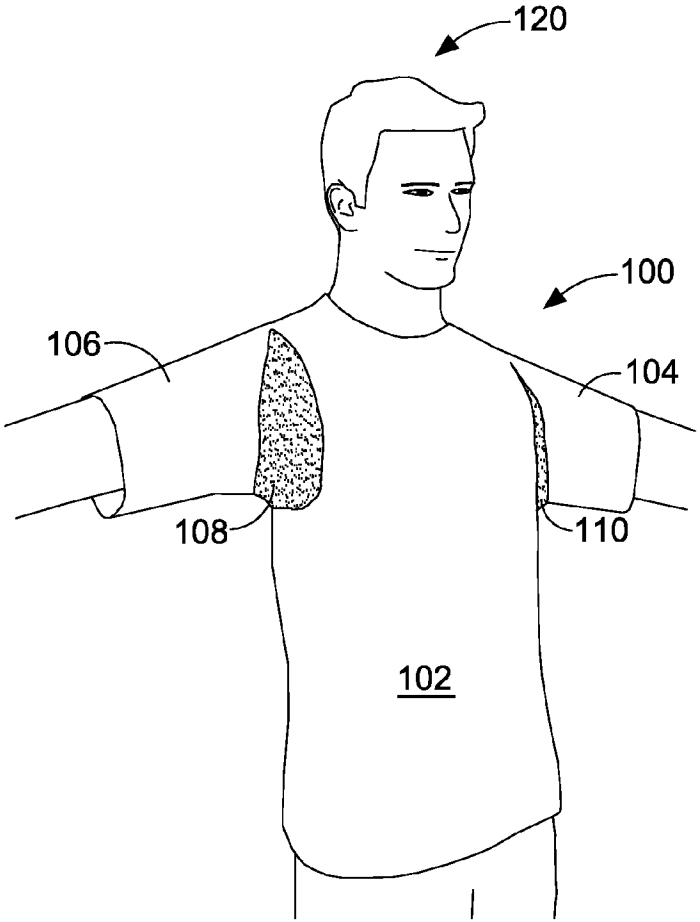
FIG. IB
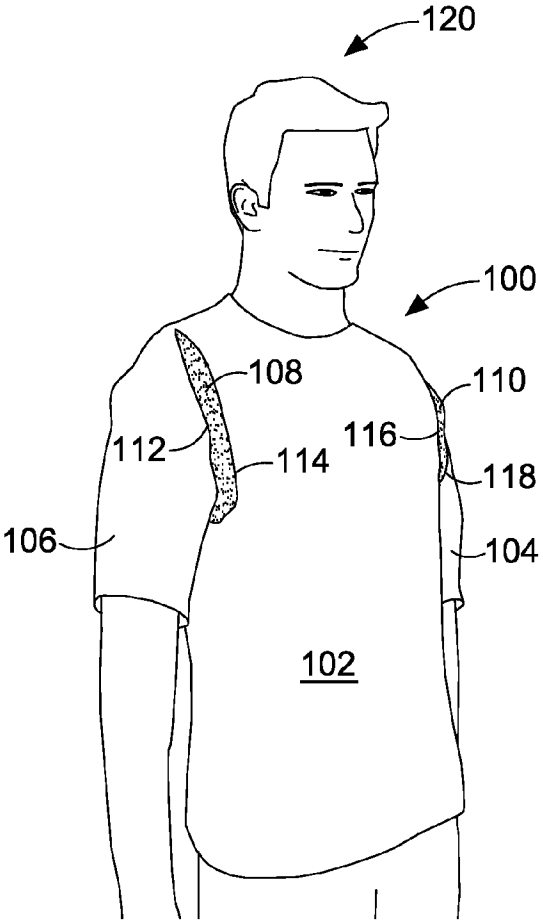
FIG. IA

CRUMPLE ZONE GARMENTS PROVIDING ENHANCED FIT

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to garments. More particularly, the present invention relates to garments with crumpleable portions joining standard portions such that the garment fits properly both when a wearer is in an extended posture and a non-extended posture.

BACKGROUND

Garment designers and tailors have long struggled with designing garments having a perfect fit. A garment designed to fit a wearer in a first posture typically does not continue to provide the same fit as the wearer moves and extends various parts of the body. This problem is conventionally solved by designing a garment to fit properly when the wearer is in a certain type of position and just accepting that the garment will not fit properly when the wearer assumes other positions. For example, a shirt may be designed with sleeves that terminate at a wearer's wrist or an inch below the wrist when the wearer's arms are by his or her side. When the wearer extends an arm, the wrist of the shirt retreats from the wrist, creating an undesired fit. An alternative solution in this example would be to design the shirt with sleeves that terminate at the wearer's wrist when the wearer's arms are extended. In this alternative, the sleeves no longer terminate at the wearer's wrist when the wearer's arms are not extended and are by his or her side.

Another conventional attempt to improve garment fit involves the use of stretchable fabrics. Stretchable fabrics can be incorporated into gussets, or more drastically, the entire garment can be made from stretchable fabrics. Garments incorporating stretchable fabrics often feel restrictive, can be difficult to fabricate, and are often aesthetically unpleasing. A long-felt need thus exists for garments that provide a proper fit across multiple wearer postures and positions.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A garment constructed of textile panels is provided. A plurality of primary textile panels have a first crumplability. At least one secondary textile panel has a second crumplability, the second crumplability being greater than the first crumplability. A plurality of seams joins the plurality of primary textile panels and the at least one secondary textile panel substantially along the edges of the panels to form a garment that when worn by a person in a non-extended posture covers intended portions of the person fully with only the plurality of primary textile panels extended and the at least one secondary textile panel non-extended. When the garment is worn by a person in an extended posture, the garment covers the intended portions of the person fully with both the plurality of primary textile panels and the at least one secondary textile panel extended. The intended portions of the person are specified by a design of the garment.

BRIEF DESCRIPTION OF THE DRAWINGS

The present invention is described in detail below with reference to the attached drawing figures, wherein:

FIG. 1A is a perspective view of a garment in accordance with an example of the present invention, the garment having armpit crumple portions and the wearer being in a non-extended posture;

FIG. 1B is a perspective view of the garment of FIG. 1A, the wearer being in an extended posture;

DETAILED DESCRIPTION

Figure 2B:
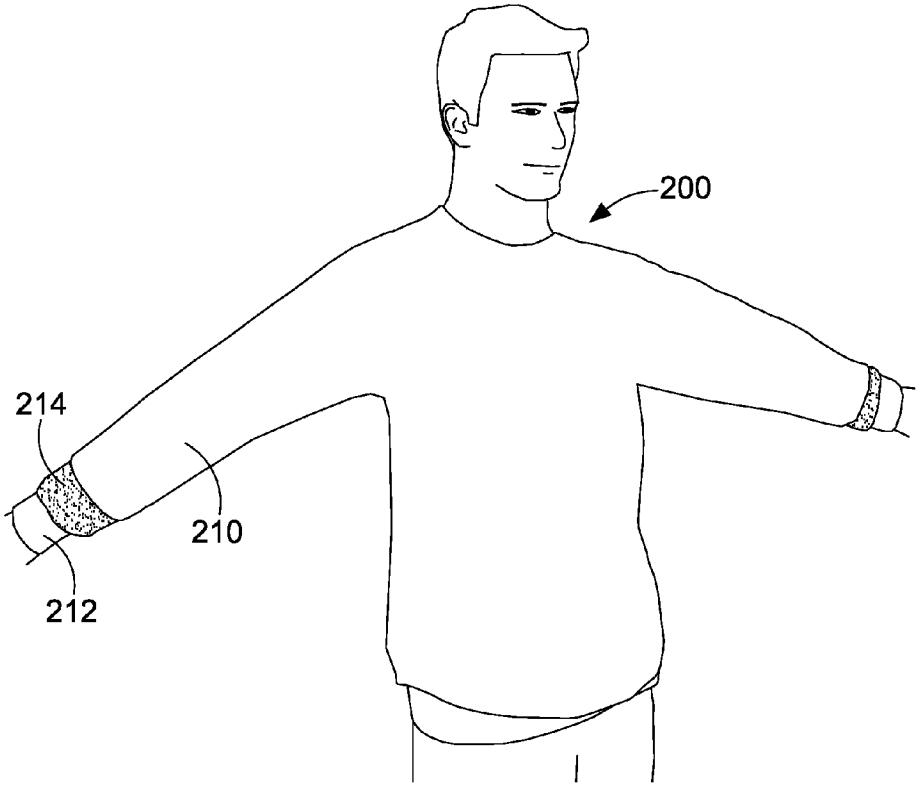
FIG. 2B is a perspective view of the garment of FIG. 2A, the wearer being in an extended posture.

Conventional garments are designed to properly fit a wearer when the wearer has assumed a single posture. When the wearer assumes a different posture, conventional garments no longer fit properly. The present invention provides garments that provide a proper fit across wearer postures and positions. Examples of the present invention are illustrated in FIGS. 1A-5.

FIG. 1A illustrates garment 100 constructed of primary textile panels 102, 104, and 106 and secondary textile panels 108 and 110. Primary textile panels 102, 104, and 106 have a first crumplability. Secondary textile panels 108 and 110 have a second crumplability that is greater than the first crumplability. Seams 112 and 114 join secondary textile panel 108 to primary textile panels 102 and 106. Seams 116 and 118 join secondary textile panel 110 to primary textile panels 102 and 104. Seams 112, 114, 116, and 118 join their respective panels substantially along the edges of the panels to form garment 100.

As used in this application, "crumplability" refers to a material's propensity to fold upon itself or crumple when external stretching or extending forces are limited. Various characteristics of a material can influence crumplability, including, but not limited to, weight, rigidity, and tightness of weave or knit. For example, in some cases a material having a light weight may crumple more easily than a material having a heavier weight and thus have a greater crumplability. Similarly, a less rigid material may have a greater crumplability than a more rigid material. Depending on the material used, a tighter weave may make a material more or less crumplable.

Crumplability can be measured using a variety of techniques. In one example, a "Handle-O-Meter," which measures the "handle" of sheeted materials (combination of surface friction and flexibility) is used. In other examples, a cantilever test, a fabric testing machine such as those manufactured by Instron®, V-Stitcher drape simulation software by Browzwear, wrinkle recovery tester, drape meter, and/or a fabric crease tester is used.

When garment 100 is worn by a person 120 in a non-extended posture as shown in FIG. 1A, garment 100 covers intended portions of person 120 fully with only primary textile panels 102, 104, and 106 extended and secondary textile panels 108 and 110 not extended. Secondary textile panels 108 and 110 are depicted as readily visible while not extended in FIG. 1A, but garment 100 may be constructed and secondary textile panels 108 and 110 may be dimensioned such that they are entirely or substantially hidden from view when wearer 120 is in a non-extended posture. In some such examples, from the viewpoint of another person viewing wearer 120, garment 100 may appear to be made only of primary textile panels 102, 104, and 106.

An exemplary non-extended posture is a person standing in a neutral position with the person's hands by the person's sides and legs approximately shoulder-width apart. FIG. 1B shows garment 100 worn by person 120 in an exemplary extended posture. When garment 100 is worn by person 120 in an extended posture, garment 100 covers the intended portions of person 120 fully with primary textile panels 102, 104, and 106 and secondary textile panels 108 and 110 extended. The portions of person 120 intended to be covered by garment 100 are specified by a design of garment 100. In accordance with the present invention, the portions of wearer 120 actually covered by garment 100 may substantially match the portions of wearer 120 intended to be covered by garment 100 regardless of the posture of wearer 120.

Primary textile panels 102, 104, and 106 and secondary textile panels 108 and 110 may be made of a variety of natural or synthetic materials. In one example, primary textile panels 102, 104, and 106 and secondary textile panels 108 and 110 have substantially similar elasticity. Although garment 100 shown in FIGS. 1A and 1B is a short-sleeved shirt, examples of the present invention include a variety of garments, including long-sleeved shirts, sweatshirts, jackets, and pants, with secondary textile panels in a variety of locations. In examples in which the garment is a pair of pants, secondary textile panels may be located in, for example, the knee, hip, or upper thigh area. In some examples, jackets or insulated pants are contemplated that comprise a plurality of primary textile panels contain an insulating fill and at least one secondary panel that does not contain an insulating fill.

In one particular example, a garment includes a plurality of primary textile panels that forms at least a torso portion and a sleeve portion, and at least one secondary textile panel joins the torso portion and the sleeve portion. In another example, a garment includes a plurality of primary textile panels that forms at least a torso portion and a hood portion, and at least one secondary textile panel joins the torso portion and the hood portion. In still a further example, a garment includes a waistband panel and a plurality of primary textile panels that forms at least a torso portion, and at least one secondary textile panel joins the torso portion and the waistband panel. In yet a further example, a garment includes a wrist cuff panel and a plurality of primary textile panels that forms at least a sleeve portion, and at least one secondary textile panel joins the sleeve portion and the wrist cuff panel. Additionally, garments with any combination of the above panels, as well as other panels not listed above, are contemplated.

Garment 100 in FIGS. 1A and 1B is described as having textile panels joined with seams. Other methods of construction are also contemplated. For example, engineered fabrics may be used. In contrast to joining multiple panels with seams, in engineered fabrics, a continuous piece of material may have different portions that each have a different crumplability. Fabrics may be engineered in such a manner by weaving or knitting the fabrics to have different portions with different crumplability. In one example, fabric can be engineered such that when the fabric is treated after construction, a portion of the fabric in an area can be selectively dissolved, "burned out," or otherwise removed while some fabric in the area remains.

Figure 2A:
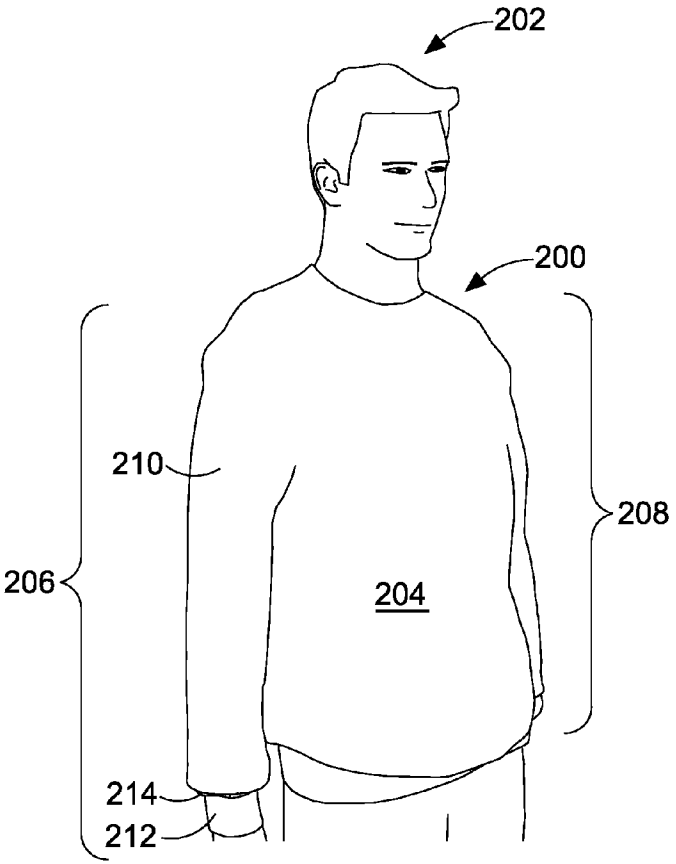
FIG. 2A is a perspective view of a garment in accordance with an example of the present invention, the garment having substantially hidden cuff crumple portions when the wearer is in a non-extended posture.

FIGS. 2A-5 illustrate additional garments in accordance with examples of the present invention. FIGS. 2A and 2B illustrate a garment 200 designed to cover the arms and torso of a wearer 202 when garment 200 is worn. A torso portion 204 covers the torso of wearer 202 when garment 200 is worn. Arm portions 206 and 208 cover the arms of wearer 202 when garment 200 is worn. Arm portion 206 comprises a first tubular-shaped arm portion textile panel 210 having a proximal end and a distal end affixed to the torso portion 204, a first tubular-shaped wrist cuff panel 212, and a first tubular-shaped secondary textile panel 214 having a proximal end and a distal end. The first secondary textile panel 214 is interposed between the distal end of the first arm portion textile panel 210 and the proximal end of the first wrist cuff panel 212 such that a first seam joins the proximal end of the first secondary textile panel 214 with the distal end of the first arm portion textile panel 210, and a second seam joins the distal end of the first secondary textile panel 214 with the proximal end of the first wrist cuff panel 212. A similar configuration exists for the arm portion 208 such that it comprises a second tubular-shaped arm portion textile panel having a proximal end and a distal end affixed to the torso portion 204, a second tubular-shaped wrist cuff panel having a proximal end and a distal end, and a second tubular-shaped secondary textile panel having a proximal end and a distal end, where the second secondary textile panel is interposed between the second arm portion textile panel and the second wrist cuff panel and joined to each by seams. The discussion of the arm portion 206 is equally applicable to the arm portion 208. First arm portion textile panel 210 extends to the shoulder of wearer 202 and encircles an upper portion of the arm of wearer 202. First arm portion textile panel 210 has a first crumplability. First wrist cuff panel 212 encircles a lower portion of the arm of wearer 202 and terminates at the wrist of wearer 202 when the arm of wearer 202 is not extended.

A length of the first and second arm portion textile panels as measured from the arm portion textile panels' respective proximal ends to the arm portion textile panels' respective distal ends is greater than a length of the first and second wrist cuff panels as measured from the wrist cuff panels' respective proximal ends to the wrist cuff panels' respective distal ends.

First secondary textile panel 214 connects first wrist cuff panel 212 and first arm portion textile panel 210. First secondary textile panel 214 encircles a portion of the arm of wearer 202 and has a second crumplability that is greater than the first crumplability. When the arm of wearer 202 is extended, for example as shown in FIG. 2B, first secondary textile panel 214 extends sufficiently that first wrist cuff panel 212 continues to terminate at the wrist of wearer 202. When the arm of wearer 202 is not extended, for example as is shown in FIG. 2A, first secondary textile panel 214 at least partially folds upon itself sufficiently that first wrist cuff panel 212 terminates at the wrist of wearer 202. FIG. 2A illustrates an example in which first secondary textile panel 214 is substantially hidden from view while wearer 202 is in a non-extended posture. In some examples, garment 200 is designed such that first secondary textile panel 214 is entirely hidden from view while wearer 202 is in a non-extended posture.

The inclusion of first secondary textile panel 214 allows wearer 202 to raise his arms, for example, to the side in an extended position without first wrist cuff panel 212 moving relative to the wrist of wearer 202. The crumpleable nature of first secondary textile panel 214 allows first secondary textile panel 214 to extend from a folded or crumpled position when necessary to alleviate the force that would normally cause first wrist cuff panel 212 to slip back from its original position on the wrist of wearer 202 as the arm of wearer 202 is extended. When wearer 202 returns his arms to his side, first secondary textile panel 214 folds upon itself to allow first wrist cuff panel 212 to continue to remain in place. In this way, a proper sleeve fit is provided to wearer 202 both when the arms of wearer 202 are extended and when they are not. In some examples, first secondary textile panel 214 is substantially removed from view when folded upon itself or crumpled and substantially placed in view when extended or uncrumpled.

Figure 3:
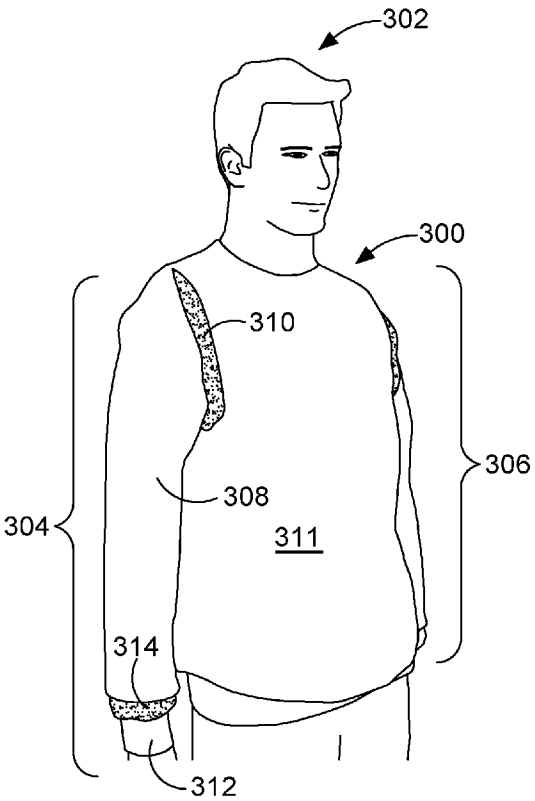
FIG. 3 is a perspective view of a garment in accordance with an example of the present invention, the garment having armpit crumple portions and cuff crumple portions.

FIG. 3 illustrates exemplary garment 300 worn by wearer 302. Arm portions 304 and 306 cover the arms of wearer 302 when garment 300 is worn. Although arm portion 306 is not shown in full detail in FIG. 3, arm portions 304 and 306 are mirrors of each other. Shoulder portion 308 extends to the shoulder of wearer 302 and encircles an upper portion of the arm of wearer 302. Shoulder portion 308 has a first crumplability. Armpit crumple portion 310 connects shoulder portion 308 and torso portion 311. Armpit crumple portion 310 corresponds to a portion of the armpit of wearer 302 and has a second crumplability greater than the first crumplability.

As the arm of wearer 302 is extended (as illustrated with regard to garment 100 in FIG. 1B), armpit crumple portion 310 extends sufficiently to allow shoulder portion 308 to move unrestricted with the arm. Garment 300 also includes a wrist cuff portion 312 and cuff crumple portion 314, similar to wrist cuff portion 212 and cuff crumple portion 214 discussed above with regard to FIGS. 2A-2B. Armpit crumple portion 310 and cuff crumple portion 314 are shown in FIG. 3 as being easily visible when wearer 302 is in a non-extended posture. In some examples, armpit crumple portion 310 and cuff crumple portion 314 are either entirely or substantially hidden from view when wearer 302 is in a non-extended posture.

Figure 4:
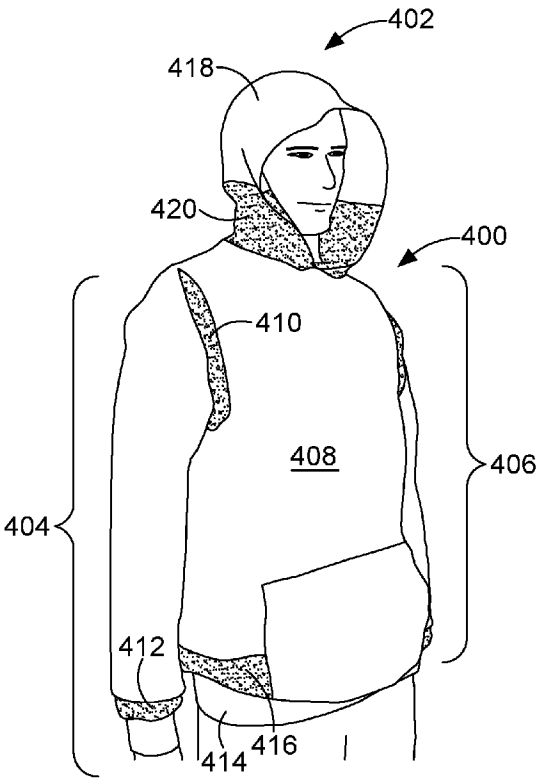
FIG. 4 is a front perspective view of a garment in accordance with an example of the present invention, the garment having armpit crumple portions, cuff crumple portions, a hood crumple portion, and a waistband crumple portion.

FIG. 4 illustrates exemplary garment 400 worn by wearer 402. Similarly to garment 300 in FIG. 3, garment 400 includes arm portions 404 and 406, torso portion 408, armpit crumple portion 410, and cuff crumple portion 412. Garment 400 also includes a waistband portion 414 that encircles the waist of wearer 402 when garment 400 is worn and terminates at the waist of wearer 402. Waistband crumple portion 416 connects waistband portion 414 and torso portion 408. Waistband crumple portion 416 encircles the waist of wearer 402. When wearer 402 assumes an extended posture, waistband crumple portion 416 extends sufficiently that waistband portion 414 continues to terminate at the waist of wearer 402. Extended postures include wearer 402 stretching his arms as well as twisting, turning, or leaning his torso. When wearer 402 assumes a non-extended posture, waistband crumple portion 416 at least partially folds upon itself sufficiently that waistband portion 414 terminates at the waist of wearer 402. In this way, waistband crumple portion 416 allows wearer 402 to, for example, raise his arms without moving waistband portion 414 relative to his waist. The force of torso portion 408 rising as wearer 402's arms are extended "uncrumples" waistband crumple portion 416 and extends waistband crumple portion 416 such that waistband portion 414 is unaffected by the movement.

Figure 5:
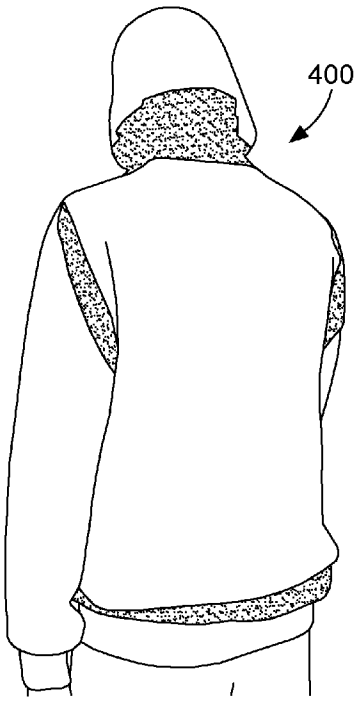
FIG. 5 is a back perspective view of the garment shown in FIG. 4.

FIG. 4 also illustrates a hood portion 418. Hood portion 418 covers the back and top portions of the head of wearer 402 when garment 400 and hood portion 418 are worn. Hood crumple portion 420 connects hood portion 418 and torso portion 408. Hood crumple portion 420 encircles the neck of wearer 402. When hood portion 418 is extended and worn, hood crumple portion 420 extends and provides enhanced head movement because hood crumple portion 420 has a greater crumplability than hood portion 418 and torso portion 408. When hood portion 418 is not extended and not worn, hood crumple portion 420 at least partially folds upon itself. Examples of an extended posture that result in extending hood crumple portion 420 include twisting, turning, and craning the neck. FIG. 5 illustrates a back view of garment 400.

Armpit crumple portion 410, cuff crumple portion 412, waistband crumple portion 416, and hood crumple portion 420 are shown in FIGS. 4 and 5 as being easily visible when wearer 402 is in a non-extended posture. In some examples, armpit crumple portion 410, cuff crumple portion 412, waistband crumple portion 416, and hood crumple portion 420 are either entirely or substantially hidden from view when wearer 402 is in a non-extended posture.

In some examples, the armpit crumple portions, cuff crumple portions, waistband crumple portions, hood crumple portions, and other crumple portions that are not shown but are contemplated are a lighter weight than the portions these crumple portions connect. This can reduce the volume occupied when these portions are folded upon themselves or crumpled and can provide less resistance to folding when not extended and to being extended when the wearer assumes an extended posture. In some examples, wrist cuff portions and waistband portions may be of a different weight than the torso, shoulder, and hood portions, but the wrist cuff portions and waistband portions are still of a heavier weight than the crumple portions.

In other examples, the torso portion, shoulder portions, hood portions, armpit crumple portions, cuff crumple portions, and waistband crumple portions have a substantially similar elasticity. Thus, it is not that the crumple portions are being stretched more than the other portions as a wearer assumes an extended posture, but rather, the crumple portions are being uncrumpled or unfolded by the force of the portions to which they are attached moving apart as the wearer assumes the extended posture.

In one example, the torso portion and shoulder portions contain an insulating fill, and the armpit crumple portions and other crumple portions do not contain an insulating fill. For example, a down or synthetic down jacket is contemplated that includes at least armpit crumple portions that do not contain insulating fill while the arm portions and torso portions do contain insulating fill. Such a design prevents uncomfortable bunching of the jacket under the wearer's arms while permitting such a jacket to fit a wearer well in a wide variety of postures.

The present invention has been described in relation to particular examples, which are intended in all respects to be illustrative rather than restrictive. Alternative examples will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

Having thus described the invention, what is claimed is:

1. A garment constructed of textile panels, the garment comprising:

a torso portion configured to cover a torso area of a wearer when the garment is in an as-worn configuration, the torso portion defining at least a neck opening, a waist opening, a first arm opening, and a second arm opening;

a first tubular-shaped arm portion textile panel having a proximal end and a distal end, the proximal end of the first tubular-shaped arm portion textile panel directly affixed to the first arm opening of the torso portion, and a second tubular-shaped arm portion textile panel having a proximal end and a distal end, the proximal end of the second tubular-shaped arm portion textile panel directly affixed to the second arm opening of the torso portion, both the first arm portion textile panel and the second arm portion textile panel are formed completely from a first material having a first crumplability, wherein crumplability comprises a propensity for a textile panel to fold over when the textile panel is in a non-extended state;

a first tubular-shaped wrist cuff panel having a proximal end and a distal end and a second tubular-shaped wrist cuff panel having a proximal end and a distal end; and a first tubular-shaped secondary textile panel having a proximal end and a distal end and a second tubular-shaped secondary textile panel having a proximal end and a distal end, the first secondary textile panel interposed between the distal end of the first arm portion textile panel and the proximal end of the first wrist cuff panel and the second secondary textile panel interposed between the distal end of the second arm portion textile panel and the proximal end of the second wrist cuff panel, the first and second secondary textile panels both being formed completely of a second material that has a second crumplability greater than the first crumplability;

wherein:

a length of the first and second arm portion textile panels as measured from the arm portion textile panels' respective proximal ends to the arm portion textile panels' respective distal ends is greater than a length of the first and second wrist cuff panels as measured from the wrist cuff panels' respective proximal ends to the wrist cuff panels' respective distal ends, a first pair of seams includes a first seam that joins the proximal end of the first secondary textile panel with the distal end of the first arm portion textile panel and includes a second seam that joins the proximal end of the second secondary textile panel with the distal end of the second arm portion textile panel, and a second pair of seams includes a third seam that joins the distal end of the first secondary textile panel with the proximal end of the first wrist cuff panel and includes a fourth seam that joins the distal end of the second secondary textile panel with the proximal end of the second wrist cuff panel;

wherein:

the first arm portion textile panel, the first wrist cuff panel, and the first secondary textile panel form a first sleeve portion of the garment, and the second arm portion textile panel, the second wrist cuff panel, and the second secondary textile panel form a second sleeve portion of the garment; and wherein: when the garment is worn by the wearer with the wearer's arms in a non-extended position, the first and second sleeve portions cover the wearer's arms fully with only the first and second arm portion textile panels extended and the first and second secondary textile panels non-extended, and when the garment is worn by the wearer with the wearer's arms in an extended position, the first and second sleeve portions cover the wearer's arms fully with both the first and second arm portion textile panels and the first and second secondary textile panels extended.

2. The garment of claim 1, wherein the first and second arm portion textile panels and at least the first secondary textile panel and the second secondary textile panel are elastic.

3. The garment of claim 1, further comprising a waistband panel affixed to the torso portion at the waist opening of the torso portion.

4. The garment of claim 1, further comprising a hood portion affixed to the torso portion at the neck opening of the torso portion.

* * * * *